US008496032B2

(12) United States Patent
Miller et al.

(10) Patent No.: US 8,496,032 B2
(45) Date of Patent: Jul. 30, 2013

(54) MANUALLY OPERABLE MANIFOLD/NOZZLE CLOSURE FOR FLUID DISPENSERS

(75) Inventors: William A. Miller, Buffalo Grove, IL (US); Scott J. Bratthauer, Huntley, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 483 days.

(21) Appl. No.: 12/877,680

(22) Filed: Sep. 8, 2010

(65) Prior Publication Data

US 2012/0055582 A1 Mar. 8, 2012

(51) Int. Cl.
*B65D 1/04* (2006.01)

(52) U.S. Cl.
USPC ..... 141/362; 222/108; 222/562; 137/313

(58) Field of Classification Search
USPC ..... 141/311 R, 351, 360, 362; 222/108, 222/533, 562; 137/312–313; 239/104, 120–122
See application file for complete search history.

(56) References Cited

U.S. PATENT DOCUMENTS 7,228,879 B2 * 6/2007 Miller et al. ..... 141/271
7,581,571 B2 9/2009 Hsing et al.

* cited by examiner

*Primary Examiner* — Jason K Niesz
(74) *Attorney, Agent, or Firm* — Miller, Matthias & Hull LLP

(57) ABSTRACT

A manually operated seal/closure system for a fluid dispenser manifold is disclosed. The manifold includes at least one nozzle and, more typically, a plurality of nozzles ranging from more than one to twelve or more. The manifold housing includes a sidewall or other stationary structure. The stationary sidewall is pivotally connected to an arm. The sidewall further includes a lateral slot and a curved slot. The arm includes a proximal end pivotally coupled to the sidewall and a distal end coupled to a push plate. The closure system also includes a bracket for supporting a cup and a spring-biased seal. The bracket is coupled to the arm and slidably coupled the sidewall by a pin that extends from the bracket through the lateral slot in the sidewall.

20 Claims, 6 Drawing Sheets

MANUALLY OPERABLE MANIFOLD/NOZZLE CLOSURE FOR FLUID DISPENSERS

TECHNICAL FIELD

An improved manifold/nozzle closure system for fluid dispensers is shown and described. The disclosed closure system is a manual system that, in a closed position, provides a cover/closure and a seal for a manifold/nozzle through which one or more fluids are dispensed. In the closed position, the closure element is disposed beneath and biased against the manifold or nozzle where it collects fluid drippings between dispensing operations and provides a sealing effect to prevent dried material from clogging or obstructing flow through the nozzle(s). The closure system may be moved manually to an open or to a dispense position.

BACKGROUND

Systems for dispensing a plurality of different fluids into a container have been known and used for many years. For example, systems for dispensing paint base materials and colorants into a paint container are known. These paint systems may use twenty or more different colorants to formulate a paint mixture. Each colorant is contained in a separate canister or package and may include its own dispensing pump. The colorants and the respective pumps may be disposed on a turntable, along one or more horizontal rows or through a dispense manifold that includes a plurality of nozzles. In a turntable system, the turntable is rotated so that the colorant to be dispensed is moved to a position above the container being filled. In designs using one or more horizontal rows, the container may be moved laterally to the appropriate colorant/pump. In manifold designs, the container or receptacle remains stationary as the colorants are sequentially or simultaneously pumped though individual nozzles held closely together by a manifold block.

Systems for dispensing large varieties of different fluids are not limited to paints, but also include systems for dispensing pharmaceutical products, hair dye formulas, cosmetics of all kinds, nail polish, etc. As noted above, some systems for use in preparing products at a point of sale may also use a stationary manifold through which a plurality of nozzles extend. Each fluid to be dispensed is then pumped through its own individual nozzle that is accommodated in the manifold. Depending upon the size of the container and the quantity of the fluids to be dispensed, manifolds can be designed in a space efficient manner so that a single manifold can accommodate twenty or more different nozzles. The nozzles are connected to the various ingredients by flexible hoses and the ingredients are contained in stationary canisters. Each canister may be associated with its own pump.

In many fluid dispensing applications, precision is essential, as many formulations require the addition of precise amounts of certain ingredients. This is true in the pharmaceutical industry but also in the paint and cosmetic industries as the addition of more or less tints or colorants can result in a visible change in the color of the resulting product.

One way in which the precision of dispensing systems is compromised is "dripping". Specifically, a "leftover" drip may be hanging from a nozzle that was intended to be added to a previous formulation and, with a new container in place under the nozzle, the drop of liquid intended for a previous formulation may be erroneously added to a new formulation.

Thus, the previous container may not receive the desired amount of the liquid ingredient and the next container may receive too much.

To solve the drip problem, various scraper and wiper designs have been proposed. However, these designs often require one or more different motors to operate the wiper element and are limited to use on dispensing systems where the nozzles are separated and not bundled together in a manifold. Use of a wiper or scraping function would not be practical in a multiple nozzle manifold design, as the ingredients from the different nozzles will be cross-contaminated by the wiper or scraper, which would then also contribute to the lack of precision of subsequently produced formulations.

Another problem associated with dispensing systems that make use of nozzles lies in the dispensing of relatively viscous liquids such as tints, colorants, base materials for paints and cosmetic products, certain pharmaceutical ingredients or other fluid materials having relatively high viscosities. Specifically, the viscous fluids have a tendency to dry and cake onto the end of the nozzles, thereby requiring frequent cleaning in order for the nozzles to operate effectively. For example, when a liquid or slurry material dries on a nozzle, the dispense stream may be misdirected causing the liquid or slurry to miss the receptacle. This problem is particularly prevalent in the dispensing of paint colorants or tints. While some mechanical wiping or scrapping devices are available, these devices are not practical for multiple nozzle manifold systems for the reasons set forth above and the scraper or wiper element must be manually cleaned anyway. Nozzles have also been known to clog entirely when exposed to air for an extended period.

SUMMARY OF THE DISCLOSURE

In satisfaction of the aforenoted needs, an improved closure system for one or more fluid outlets is disclosed.

A disclosed manifold and closure system for a fluid dispenser comprises a manifold housing that supports a manifold. The manifold comprises at least one nozzle and, more typically, a plurality of nozzles ranging from more than one to twelve or more. The manifold housing comprises a sidewall or other stationary structure. The sidewall or stationary structure is pivotally connected to an arm. The sidewall or stationary structure further comprises a lateral slot and a curved slot. The arm comprises a proximal end pivotally connected to the sidewall or stationary structure at the curved slot. The arm further comprises a distal end connected to a push plate. The arm also comprises a mid-section connected to a bracket that supports a cup, seal and biasing element that biases the cup and seal in an upward direction. The bracket is coupled to mid-section the arm and the sidewall or stationary structure by two pins including a rear pin that extends from a rear portion of the bracket through the lateral slot in the sidewall or stationary structure and a front pin that couples a front portion of the bracket to the mid-section of the arm.

The slots disposed in the sidewall control the relative movement of the arm and bracket with respect to the manifold. Specifically, the lateral slot in the sidewall slants or curves upwardly at its forward end. The bracket is connected to the rear pin that ride in this lateral slot. As the rear pin reaches the forward end of the lateral slot, it follows the upward path of the end of the slot thereby making a sealing engagement between the seal and the manifold. The bracket also comprises one or more biasing elements the bias the cup and seal upward against the manifold for an enhanced seal.

In a refinement, the one or more biasing elements comprise one or more flat springs.

In a refinement, the system includes a pair of arms and a pair of stationary sidewalls that include the like or identical slots.

In another refinement, another biasing member is employed that biases the arm and bracket laterally into the sealing engagement with the manifold. In another refinement, the biasing member is an extension spring.

In a refinement, the biasing member is an extension spring connected to the arm between the proximal and distal ends thereof and to the sidewall.

In another refinement, at least one of the bracket or arm is connected to a convenient handle or push plate to move the closure system from the closed or sealed position to an open or dispense position where a container may be disposed below the manifold.

In a refinement, the cup is removable from the seal and bracket. In another refinement, the cup is disposable. In another refinement, the cup and seal are connected and are removable and/or disposable.

In another refinement, the seal is ring-shaped and is disposed on a ring plate that is disposed between the bracket and the seal. In a further refinement of this concept, one or more biasing elements are disposed between the ring plate and the bracket. In still a further refinement of this concept, one or more biasing elements comprise one or more flat springs disposed between the ring plate and the bracket that bias the ring plate and the seal towards the manifold when the closure system is in a closed position.

A closure system for a fluid outlet is also disclosed. One disclosed closure system comprises a housing comprising a pair of spaced-apart sidewalls, a pair of spaced-apart arms, and a bracket extending between and connecting the arms. Each sidewall comprises a lateral slot and a curved slot. Each arm further comprises proximal end coupled to the sidewall and slidably coupled to the curved slot and a distal end coupled to a push plate. A mid-section of the arm is coupled to a bracket. The bracket supports a cup and a seal and is disposed between and coupled to the arms by a front pair of oppositely directed pins that extend outward from the bracket. A rear portion of the bracket is slidably coupled the lateral slots of sidewalls by a rear pair of oppositely directed pins that extend outward from the bracket and are received in the lateral slots.

The slots disposed in the sidewalls are identical or similar dimensionally and spatially and are used control the relative movement of the bracket. In a refinement, the lateral slots in the sidewalls curve or slant upwardly at their forward ends. The bracket is connected to two pair of pins, front and rear, or four pins in total. The rear pins ride in the lateral slots. As the rear pair of pins reaches the forward ends of their respective lateral slots, they follow the upward path of the forward ends of the slots thereby causing the bracket to move upward into a closed/sealing position against the manifold.

In a refinement, a pair of biasing members are provided that bias each arm and the bracket towards the closed or sealed position. In a refinement, the biasing members comprise a pair of extension springs linking each arm to one of the sidewalls.

In another refinement, a push plate disposed between and connecting distal ends of the arms.

A disclosed method for dispensing fluid comprises: providing a closure element with a seal member below a nozzle manifold wherein the closure element provides a sealing cover below the manifold to protect the manifold and fluid contained therein from the ambient atmosphere; moving the closure element vertically downward and laterally rearward away from the nozzle manifold; dispensing fluid from the nozzle; moving the closure element laterally forward and then vertically upward back the area beneath and in an upward biased position against the nozzle manifold; and engaging the closure element with said seal member against the manifold under force imposed by a biasing member trapped between the bracket that supports the closure element and the closure element.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein.

While a single embodiment is shown and described, alternative embodiments and variations will be described below and still other variations will be apparent to those skilled in the art. It should also be understood that the drawings are not necessarily to scale and that the disclosed embodiment is sometimes illustrated diagrammatically and in partial views. In certain instances, details which are not necessary for an understanding of the disclosed methods and apparatus or which render other details difficult to perceive may have been omitted. It should be understood, of course, that this disclosure is not limited to the particular embodiment illustrated herein.

DETAILED DESCRIPTION OF THE PRESENTLY PREFERRED EMBODIMENTS

Figure 1:
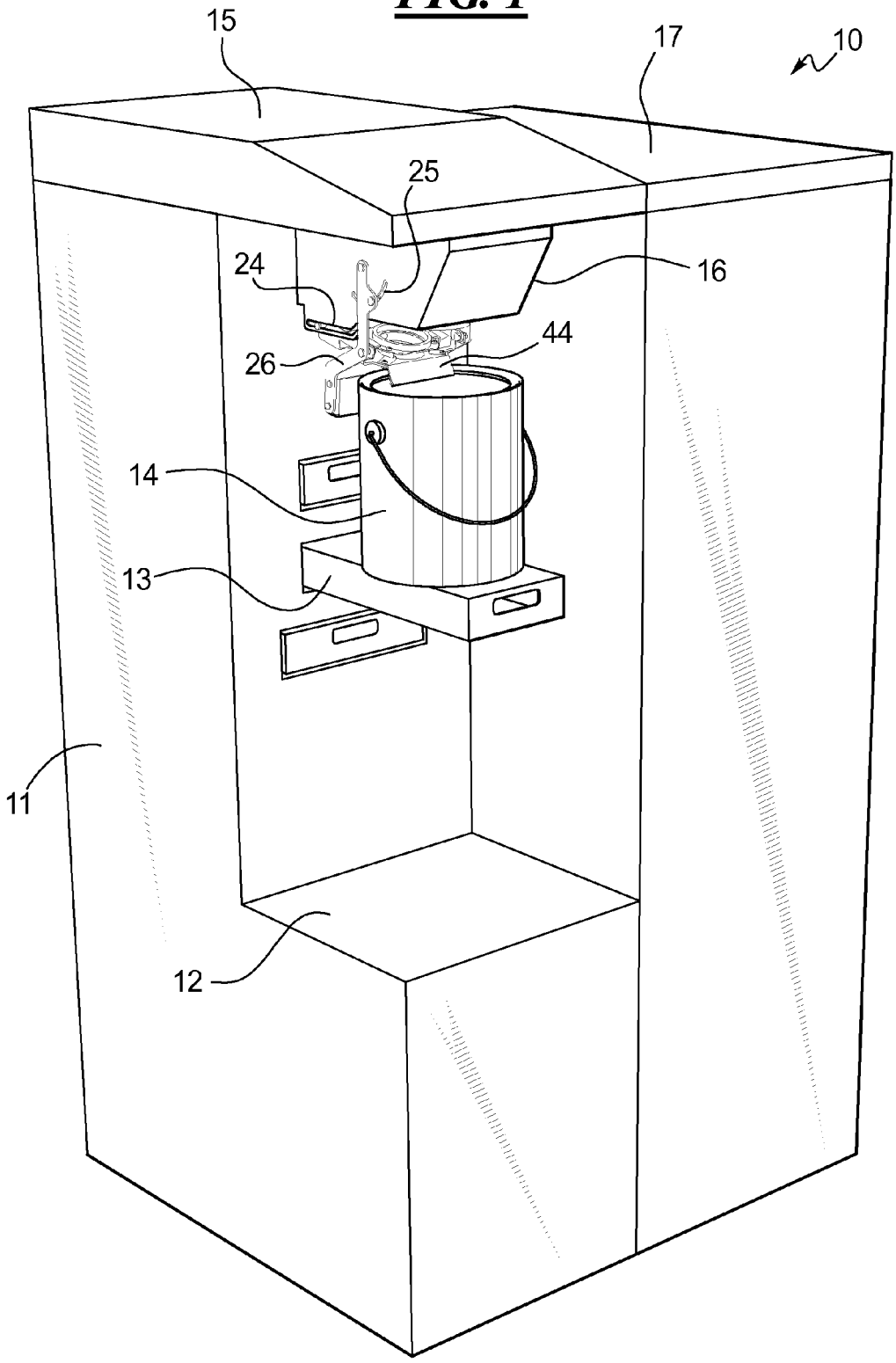
FIG. 1 is a left front perspective view of a fluid dispensing system equipped with a manual manifold/nozzle closure mechanism made in accordance with this disclosure as well as a container for receiving dispensed fluid disposed beneath the manifold whereby the closure mechanism is in the open or dispense position.

Turning to FIG. 1, a fluid dispenser 10 is disclosed which includes a housing 11 that includes a platform 12 for supporting a container to be filled. In a particular scenario illustrated in FIG. 1, an additional retractable support 13 is provided for supporting a smaller container 14, such as a one-gallon can as shown. Retraction of the support 13 allows the dispenser 10 to accommodate a larger pail, such as a five-gallon pail (not shown). A manifold cover 15 covers and protects the manifold housing 16 and a canister cover 17 covers and protects a plurality of canisters accommodated in the housing 11 (the canisters are not shown in FIG. 1).

Figure 2:
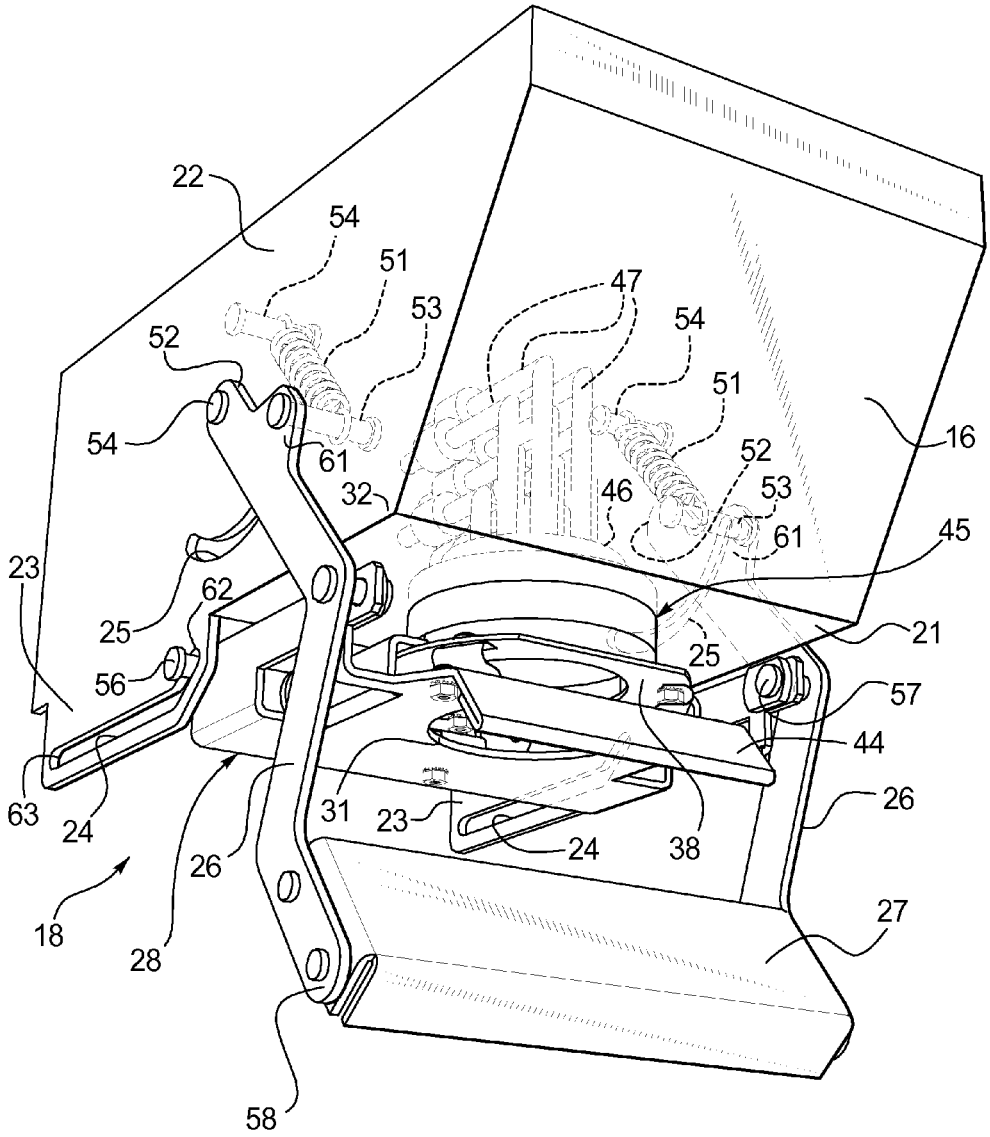
FIG. 2 is a partial left front perspective view of the fluid dispensing system, manifold/nozzle closure mechanism, in the closed position.
Figure 3:
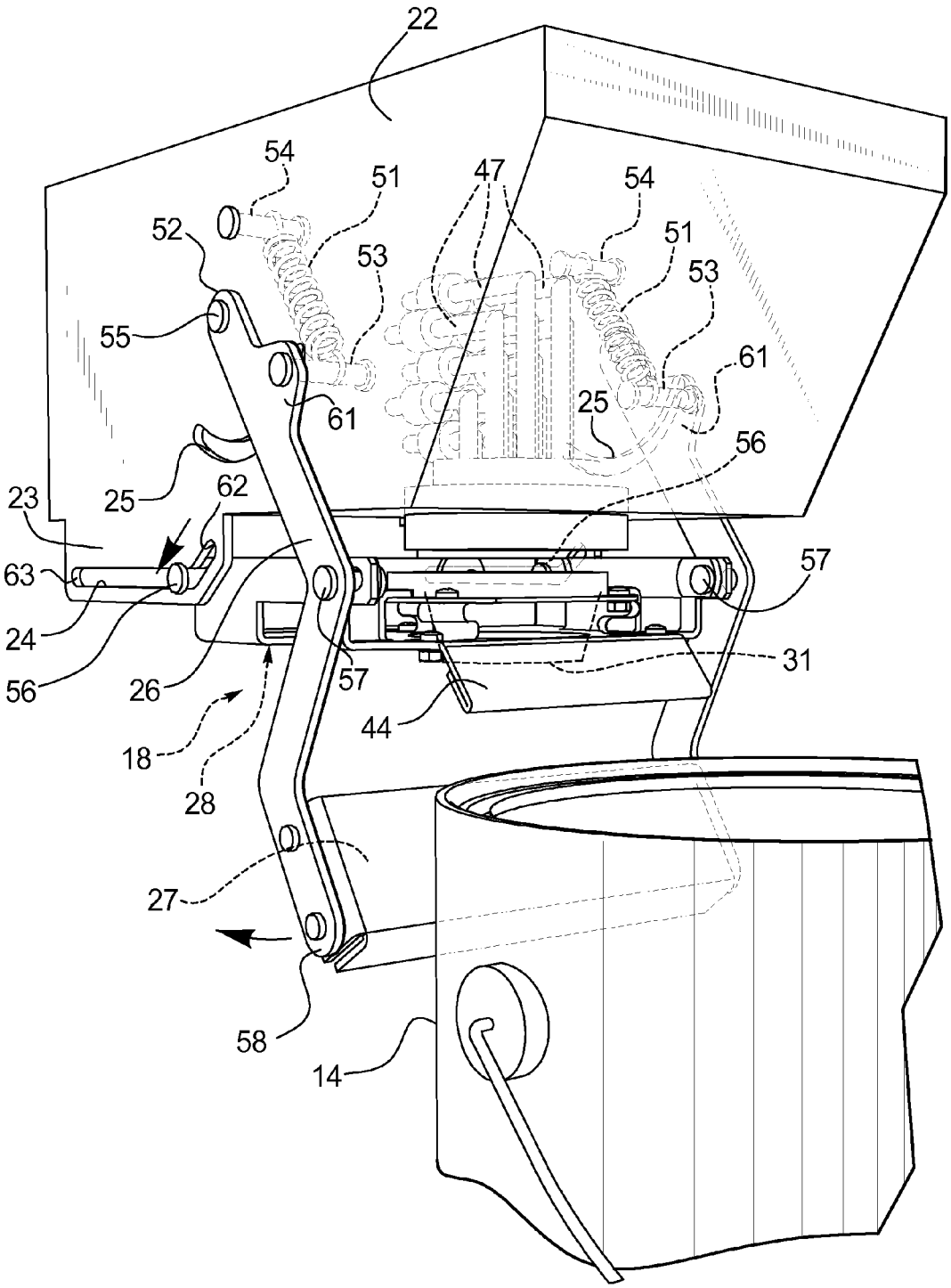
FIG. 3 is left front perspective view of the manifold/nozzle closure mechanism shown in FIGS. 1 and 2 in a partially open position.
Figure 4:
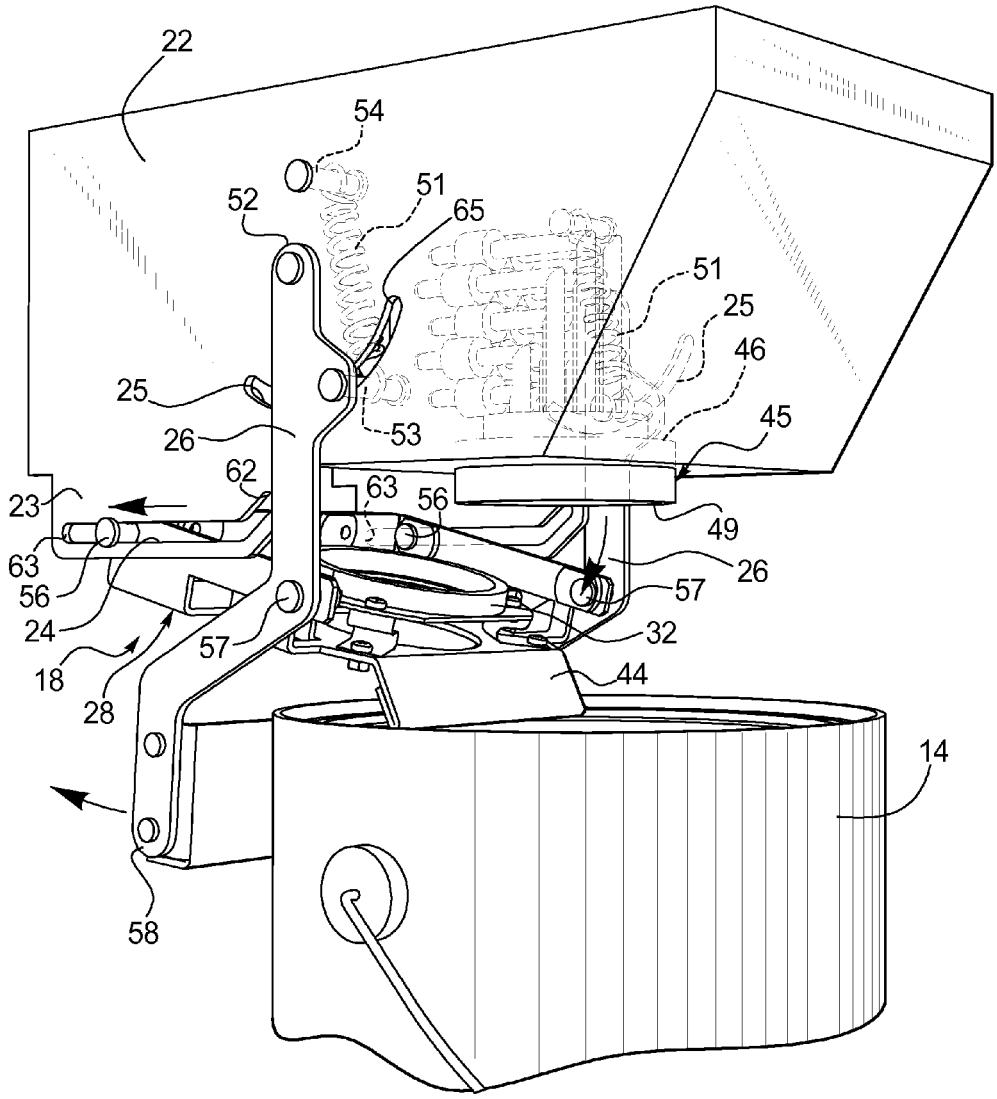
FIG. 4 is left front perspective view of the manifold/nozzle closure mechanism shown in FIGS. 1-3 in an open or dispense position.

Turning to FIG. 2, shift the manifold housing 16 and closure mechanism 18 is shown in detail. The housing 16 is includes a bottom floor 21 disposed between opposing sidewalls 22 (only one of which is shown in FIGS. 2-4). The opposing sidewalls 22 are each connected integrally to a lower extension 23. Each lower extension includes a lateral slot 24. Each sidewall also includes a curved slot 25. The slots 24, 25 are used to control the movement of the spaced-apart arms 26. The spaced-apart arms 26 are connected together by two elements—the push plate 27 and the cup/seal bracket 28. The cup/seal bracket 28 includes an opening 29 for accommodating a drip catcher cup 31 (see FIGS. 3 and 6).

Figure 5:
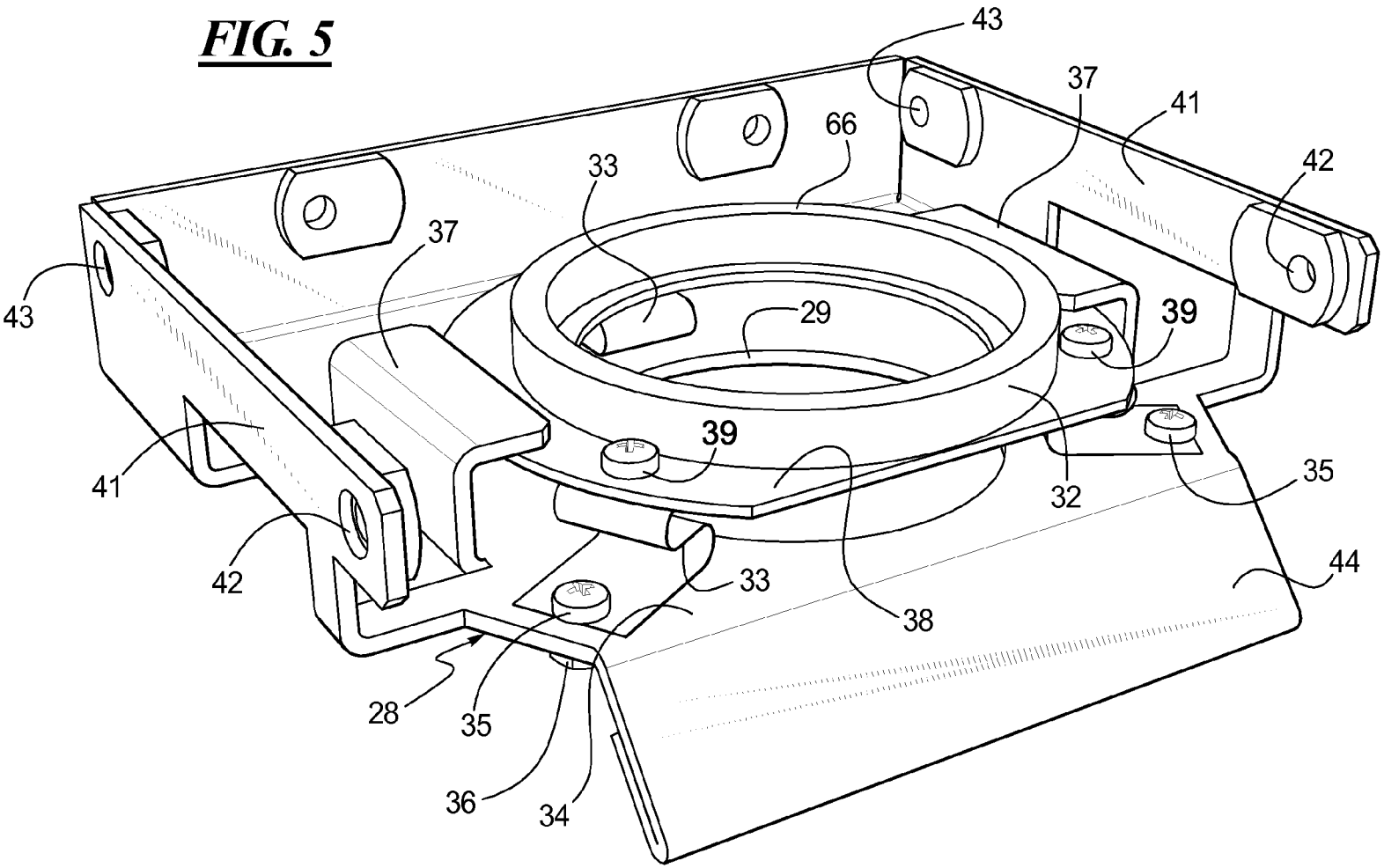
FIG. 5 is a left front perspective view of the bracket, seal and biasing elements of the disclosed closure system.
Figure 6:
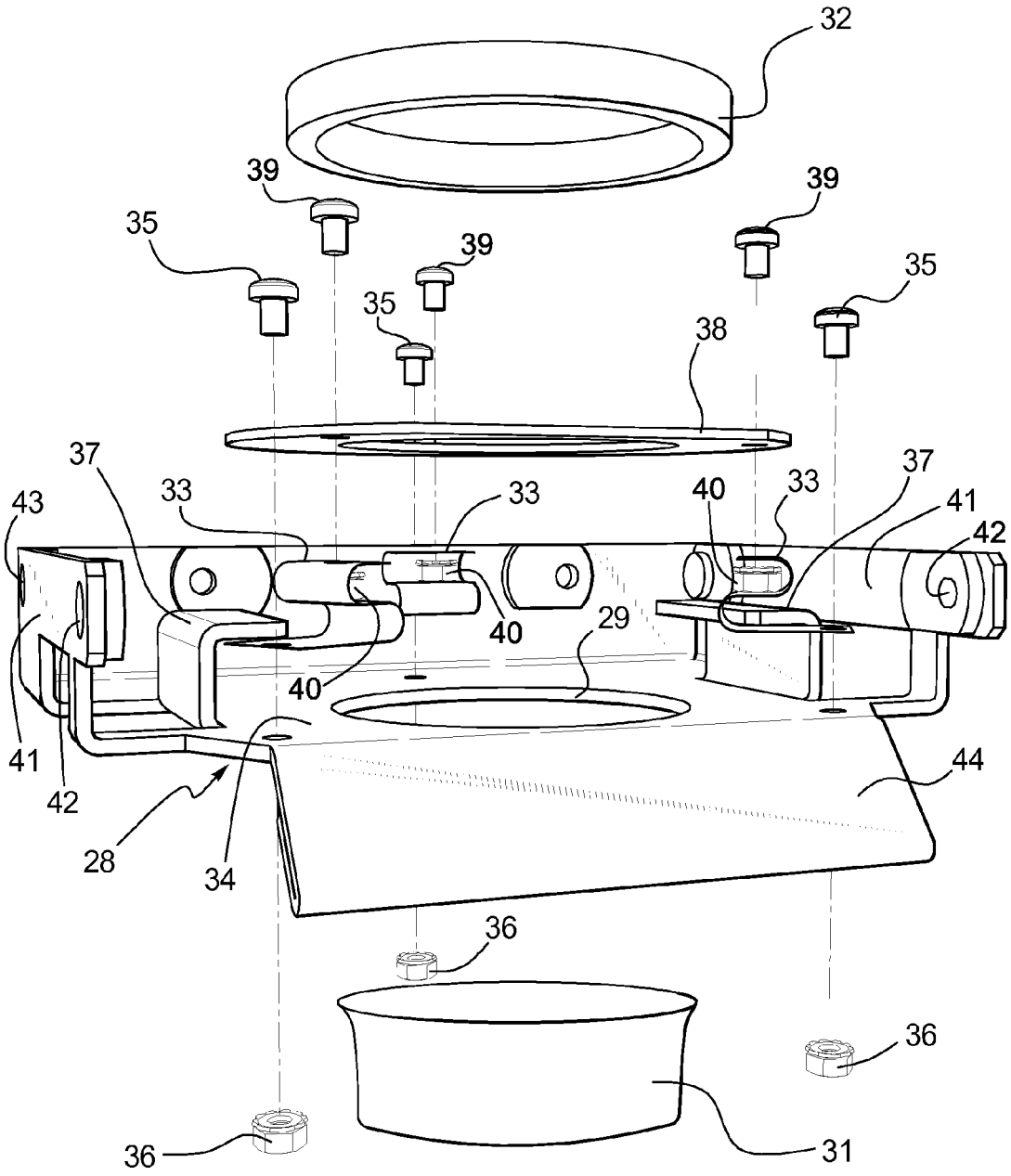
FIG. 6 is an exploded view of the cup, seal, bracket and biasing elements.

Turning to FIGS. 5 and 6, the bracket 28, seal 32 and seal biasing elements 33 will be explained in detail. The bracket 28 includes a bottom floor 34 through which the opening 29 extends. The floor 34 is connected to three biasing elements 33 (see FIG. 6) which are connected to the floor 34 by a conventional means, including, but not limited to a threaded fastener such as a threaded screw 35 and nut 36. The floor 34 is also connected to two stop members 37. The stop members 37 limit the upward movement of the ring plate 38 and seal 32 as a result of the biasing elements 33. The screws 39 and nuts 40 connect the ring plate 38 to the upper portions of the biasing elements 33. The bracket 28 also includes upwardly protruding sidewalls 41 each of which includes a front through-hole 42 and a rear through-hole 43. The ramped front end 44 provides a handle for pushing the bracket downward and away from the manifold 45, although the push plate 27 is better designed for this purpose. The seal 32 can be made from a variety of different soft materials with elastomeric properties. The specific material from which the seal 32 is made is not crucial and various alternatives will be apparent to those skilled in the art.

Returning to FIG. 2, the manifold 45 comprises an upper block 46 connected to a plurality of inlet lines 47 and a lower extension 48 for accommodating the nozzles (not shown). Referring to FIGS. 2-4, the lower rim 49 engages the seal 32 to prevent drying out of material disposed in the nozzles and, consequently, the clogging of the nozzles.

Still referring to FIGS. 2-4 the movement of the closure mechanism 18 between the closed/seal position (FIG. 2) and open/dispense position (FIG. 3) will be described in greater detail. Turning first to FIG. 2, the arms 26, push plate 27, cup/seal bracket 28, cup 31 and seal 32 are all biased forward and upward by the springs 51, which also couple the proximal ends 52 of the arms 26 to the manifold housing sidewalls 22 by way of the pins 53, 54. Obviously, the springs 51 could be disposed at numerous different places and could be connected to the bracket 28 as opposed to the arms 26. Further, only a single spring 51 may be necessary. As the springs 51 pull the bracket 28 and seal 32 forward and upward thereby forcing the seal 32 against the lower rim 49 of the manifold 45, the arms 26 each pivot about a pin 55 coupled to one of the sidewalls 22.

During this pivotal motion of the arms 26, the movement of the arms 26 is controlled by the pins 52, 53, 56, 57 which couple the arms 26 to the sidewalls 22, the arms 26 to the bracket 28 and the arms 26 to the curved slots 25 and lateral slots 24. Specifically, the pins 56, 57 are coupled to the front and rear portions of the bracket 28 respectively. The pins 56 also ride in the lateral slots 24 disposed in the lower wall extension 23. Further, the tab 61 disposed on each arm 26 includes another pin 53 that rides in the curved slot 25 and which is also connected to the spring 51.

Referring back to FIG. 2, in the closed position shown, the pins 56 connected to the front of the bracket 28 are nested against the forward end 62 of the transverse slot 24, which, as best shown in FIG. 3, is curved or slanted forwardly and upwardly. The shape of the transverse slot 24 at its forward end 62 moves the bracket 28, cup 31 and seal 32 forwardly and upwardly to assume the closed/seal position shown in FIG. 2.

In contrast, as shown in FIG. 4, in the fully open/dispense position, the pins 56 have been pushed back against the rearward end 63 of the transverse slot 24 and against the bias of the springs 51. The rearward ends 63 of the slots 24 are best seen in FIG. 3. Similarly, the pins 53 disposed away from the forward end 65 of the curved slot 25 (see FIG. 4). I In FIG. 3, the pins 56 are disposed in the horizontal portions of the slots 24 and therefore parallel with the pin 57 as the closure mechanism is moved either away from or towards the manifold 45. The cup 31 as shown in FIGS. 3 and 6 may be frictionally fitted to the opening 29 in the floor 34 of the bracket 28 and below the seal 32. The cup 31 may be disposable or removable and cleanable. Preferably, but not necessarily, the seal 32 is fastened to the ring plate 38 by glue or adhesive although other attachment means may be utilized.

In FIG. 2, the arms 26 and bracket 28 are shown in their forward or closed position. The pins 56 and 53 are nested at the forward ends 62, 65 of the slots 24, 25 respectively. The biasing elements 33 insurer and even inconsistent seal between the upper rim 66 of the seal 32 in the lower rim 49 of the manifold 45.

Therefore, the manifold/nozzle closure mechanism 18 provides a simple and efficient mechanism for moving a sealing element 32 and cup 31 vertically upward to engage a lower extension of a manifold 45 to reduce exposure of fluid nozzles to air and to catch drips. The closure mechanism 18 also provides an easy and convenient means for moving the seal 32 and cup 31 downward prior to moving the seal 32 and cup 31 laterally rearward to a position disposed away from the fluid path. By employing a spring bias, the mechanism 18 provides simple means for returning the seal 32 and cup 31 to the original sealed/closed position automatically.

It will be noted that the disclosed embodiment includes a manifold block 45/46 with a plurality of nozzles (not shown). It is anticipated that the disclosed closure mechanism would be applicable to systems with a single nozzle dispense. It is also anticipated that the disclosed mechanism 18 could be used to retrofit existing dispensers 10.

Industrial Applicability

A manifold and closure mechanism 18 for a fluid dispenser 10 is disclosed. The manifold and closure mechanism 18 comprises a manifold housing 16 supporting a manifold 45. The manifold 45 comprises or accommodates at least one nozzle. The manifold housing 16 comprises a sidewall 22. The sidewall 22 is pivotally connected to an arm 26. The sidewall 22 comprises a lateral slot 24 and a curved slot 25. The arm 26 comprises a proximal end 52 and a distal end 58. The proximal end 52 of the arm 26 is pivotally connected to the sidewall 22. The arm 26 is slidably coupled to the curved slot 25 of the sidewall 22. The mechanism 18 also comprises a bracket 28 that supports a cup 31 and a spring-biased seal 32. The bracket 28 is coupled to the 26 arm and is slidably coupled to the lateral slot 24.

A first biasing member 33 may be disposed between the seal 32 and the bracket 28 for biasing the seal 32 upward and away from the bracket 28 and towards the manifold 45. The seal 32 may be in the form of a circular ring 32 and the first biasing member may be in the form of a plurality of biasing members spaced around the circular ring 32. A ring plate 38 may be disposed between the bracket 28 and the seal 32 and the first biasing member 33 may be disposed between the ring plate 38 and the bracket 28. The first biasing member 33 may comprises at least one flat spring 33. Other types of springs or biasing members 33 will be apparent to those skilled in the art. In one embodiment, a plurality of flat springs 33 are spaced apart around the ring plate 38 such as the three flat springs 33 shown in FIG. 6.

The lateral slot 24 in the sidewall 22 may comprise a forward end 62 and a rearward end 63. The forward end 62 may slant upward vertically at an angle of less than 90° to lift the bracket 28 and seal 32 towards the manifold 45 as the closure mechanism 18 moves to a closed or sealed position (FIG. 2) and to drop the bracket 28 and seal 32 away from the manifold 45 as the closure mechanism 18 moves from the closed position (FIG. 2) towards an open position (FIG. 4). The portion of the lateral slot 24 disposed between the forward and rearward ends 62, 63 of the lateral slot 24 may be substantially straight and substantially horizontal. To bias the closure mechanism 18 towards the closed position shown in FIG. 2, a second biasing member 51 in the form of an extension spring 51 may be employed that biases the arm 26 and bracket 28 towards the manifold 45 as illustrated in FIG. 2. Accordingly, to move the closure mechanism 18 from the position shown in FIG. 2 through the position illustrated in FIG. 3 and towards the open position shown in FIG. 4, the bias of the spring 51 or springs 51 must be overcome.

The cup 31 may be removable from the seal 32 or ring plate 38 and bracket 28. The cup 31 may also be disposable. As illustrated in FIGS. 2-4, a second arm 26, sidewall 22, curved slot 25 and lateral slot 24 may be employed. A push plate 27 may be disposed between the two arms 26 and may connect the distal ends 58 of the arms 26.

The foregoing description of the exemplary embodiment has been presented for purposes of illustration and description. This disclosure is not intended to be limited to particular embodiment illustrated herein and the alternative embodiments described herein. Other alternatives, modifications and variations will be apparent to those skilled in the art in light of the above disclosure. The disclosed closure system is applicable to almost any fluid dispensing apparatus that dispenses single or multiple fluids. Accordingly, this disclosure is intended to embrace all alternatives, modifications and variations that fall within the spirit and scope of the appended claims.

What is claimed:

1. A manifold and closure system for a fluid dispenser, the manifold and closure system comprising:

a manifold housing supporting a manifold, the manifold comprising at least one nozzle, the manifold housing comprising a sidewall, the sidewall being pivotally connected to an arm, the sidewall comprising a lateral slot and a curved slot, the arm comprising a proximal end and a distal end, the proximal end pivotally connected to the sidewall, the arm being slidably coupled to the curved slot of the sidewall, a bracket supporting a cup and a spring-biased seal, the bracket being coupled to the arm and slidably coupled lateral slot.

2. The manifold and closure system of claim 1 further comprising a first biasing member disposed between the seal and the bracket for biasing the seal upward and away from the bracket and towards the manifold.

3. The manifold and closure system of claim 1 wherein the seal comprises a circular ring and first biasing member comprises a plurality of biasing members spaced around the circular ring.

4. The manifold and closure system of claim 2 further comprising a ring plate disposed between the bracket and the seal and wherein the first biasing member is disposed between the ring plate and the bracket.

5. The manifold and closure system of claim 1 wherein the first biasing member comprises at least one flat spring.

6. The manifold and closure system of claim 3 wherein the plurality of biasing members are flat springs.

7. The manifold and closure system of claim 4 wherein the first biasing member comprises a plurality of flat springs.

8. The manifold and closure system of claim 1 wherein the lateral slot in the sidewall comprises a forward end and a rearward end, the forward end slants upward vertically at an angle of less than 90°.

9. The manifold and closure system of claim 8 wherein a portion of the lateral slot disposed between the forward and rearward ends of the lateral slot is substantially straight and substantially horizontal.

10. The manifold and closure system of claim 1 further comprising a second biasing member that biases the arm and bracket towards the manifold.

11. The manifold and closure system of claim 10 wherein the second biasing member biases the bracket and seal towards the manifold.

12. The manifold and closure system of claim 11 wherein the second biasing member is an extension spring.

13. The manifold and closure system of claim 1 wherein the cup is removable from the seal and bracket.

14. The manifold and closure system of claim 13 wherein the cup is disposable.

15. The manifold and closure system of claim 1 further comprising a second arm disposed opposite the bracket from the other arm and a second sidewall disposed opposite the manifold from the other sidewall, the second arm being pivotally connected to the second sidewall.

16. The manifold and closure system of claim 15 further comprising a push plate disposed between and connecting distal ends of the arms.

17. A closure system for a fluid outlet, the system comprising:

a manifold housing supporting a cylindrical manifold, the manifold encircling a plurality of nozzles, the manifold housing comprising two opposing sidewalls, each sidewall being pivotally connected to an arm, each sidewall comprising a lateral slot and a curved slot, each arm comprising a proximal end and a distal end, each proximal end being pivotally connected to its respective sidewall, each arm being slidably coupled to the curved slot of its respective sidewall, a bracket supporting a cup and a spring-biased ring-shaped seal, the bracket being coupled between the two arms and slidably coupled lateral slots of the two opposing sidewalls.

18. The manifold and closure system of claim 17 further comprising a plurality of springs disposed between the seal and the bracket for biasing the seal upward and away from the bracket and into a matching registry engagement with the manifold when the manifold and closure system is in a closed position.

19. The manifold and closure system of claim 18 further comprising a ring plate disposed between the bracket and the seal and wherein the plurality of springs are disposed between the ring plate and the bracket.

20. A closure system for a fluid outlet, the system comprising:

a manifold housing supporting a cylindrical manifold, the manifold encircling a plurality of nozzles, the manifold housing comprising first and second opposing sidewalls, the first sidewall being pivotally connected to a first arm, the second sidewall being pivotally connected to a second arm, each sidewall comprising a lateral slot and a curved slot, each arm comprising a proximal end and a distal end, each proximal end being pivotally connected to its respective sidewall, each arm being slidably coupled to the curved slot of its respective sidewall, a bracket supporting ring plate, which supports a cup and a spring-biased ring-shaped seal, the bracket being coupled between the two arms and slidably coupled lateral slots of the two opposing sidewalls, the bracket further supporting a plurality of compression springs disposed between the ring plate and the bracket for biasing the seal upward and away from the bracket and into a matching registry engagement with the manifold when the manifold and closure system is in a closed position, the first arm being connected to a first extension spring which is connected to the first sidewall, the second arm being connected a second extension spring which is connected to the second sidewall, the first and second extension springs biasing the first and second arms and bracket towards the closed position.

* * * * *